US007357224B2

(12) United States Patent
Halevy

(10) Patent No.: US 7,357,224 B2
(45) Date of Patent: Apr. 15, 2008

(54) PERSONAL EMERGENCY ESCAPING DEVICE FROM SKYSCRAPERS

(76) Inventor: Daniel Halevy, 1 Galil Street, P.O. Box 1271, Reut-Maccabim 71908 (IL)

( * ) Notice: Subject to any disclaimer, the term of this patent is extended or adjusted under 35 U.S.C. 154(b) by 201 days.

(21) Appl. No.: 10/942,750

(22) Filed: Sep. 16, 2004

(65) Prior Publication Data

US 2005/0098383 A1 May 12, 2005

(30) Foreign Application Priority Data

Sep. 18, 2003 (IL) ..... 158019

(51) Int. Cl.
*A62B 1/14* (2006.01)

(52) U.S. Cl. ..... 182/233; 182/192; 182/193

(58) Field of Classification Search ..... 182/5–7, 182/231, 233, 234, 235, 236, 238–240, 72, 182/191–193

See application file for complete search history.

(56) References Cited

U.S. PATENT DOCUMENTS 3,739,875 A * 6/1973 Clark-Padwicki ..... 182/6
4,674,599 A * 6/1987 Nelson ..... 182/231
4,781,269 A * 11/1988 Clay ..... 182/5
4,850,161 A * 7/1989 McGinnis ..... 52/108
5,586,617 A 12/1996 England et al.
6,398,606 B1 6/2002 Borrelli
6,405,831 B1 6/2002 Daniel
6,467,575 B1 10/2002 Chen
6,550,576 B1 4/2003 Meller
2001/0046821 A1 11/2001 Stimpson et al.
2002/0111095 A1 8/2002 Borrelli
2002/0139029 A1 10/2002 Cheng
2002/0179372 A1 12/2002 Schreiber et al.
2003/0070872 A1 4/2003 Meller
2003/0070873 A1 4/2003 Meller
2003/0085073 A1 5/2003 Takeshima

* cited by examiner

*Primary Examiner*—Alvin C Chin-Shue
(74) *Attorney, Agent, or Firm*—Ladas and Parry LLP

(57) ABSTRACT

Escape device that comprises a sliding box worn by each escaping person, such that the escape device is combined with an escape cable. The sliding box comprises a supporting structure; a driven wheel supported in the structure for rotation, and adapted to be in engagement with the escape cable and to be driven thereby into rotation. The rotary speed correspond to the speed of the motion of the sliding box relative to the escape cable, and therefore, corresponds to the speed of descent of the escaping person; means for measuring the rotary speed of the driven wheel and therefore, the speed of descent of the escaping person; and braking means, for slowing the rotation of the driven wheel, and therefore the speed of descent of the escaping person, whenever it is required to maintain the speed of descent within predetermined limits.

5 Claims, 15 Drawing Sheets

PERSONAL EMERGENCY ESCAPING DEVICE FROM SKYSCRAPERS

FIELD OF THE INVENTION

The present invention relates to personal escaping equipment. More particularly, the invention relates to a personal escaping device for allowing persons to escape skyscrapers in emergency cases.

BACKGROUND OF THE INVENTION

As population grows all over the world, land has become more and more expensive, especially when it comes to a land under the jurisdiction of major cities. In order to allow relatively large population to occupy a given area, while maintaining reasonable costs, building tall buildings in general and sky scrappers in particular has become a necessity, and therefore, a common practice. Accordingly, tall buildings, including sky scrapers, are most typical to modern cities all over the world. However, tall buildings pose a special problem, which is related to their being high; i.e., escaping high buildings in; e.g., a case of fire, is problematic. The problem is related to several facts: (1) most aerial ladder trucks have standard collapsible fire ladders, or tower ladders, that are incapable of coping with the loftiness of high buildings. That is, a standard collapsible fire ladder may reach only limited number of floors of a tall building; (2) Even in cities where the fire brigade has very long ladders, it is most likely that the ladder truck would get stuck in a traffic jam, which is most common phenomena in modern cities. Any delay in reaching a building where a long ladder is required, might jeopardize the lives of the building residents; (3) Even if a sufficiently long ladder is brought to the site on time, the ladder could support, at a given time, only a few people because the longer the ladder, the more it tends to swing, thereby risking the lives of the people that it supports; (4) Due to the physical strength that is required when descending a long ladder, it is usually very difficult for fat or sick people to utilize such tall ladders, if at all; (5) The environmental circumstances may be so, that there might be a chance that even though long ladders are available, it would be very difficult, if at all, to handle the turntable mounting of the aerial ladder truck and put the ladder in the right place and/or on time.

Currently, there are several solutions for coping with the problem of people being required, or compelled, to timely evacuate tall buildings.

U.S. Pat. No. 6,550,576 discloses a rescue system for rescuing occupants from high floors in tall buildings. However, the rescue system of U.S. Pat. No. 6,550,576 has the drawback that each one of the rescued persons would have to use a personal cable cartridge. The problem is that the weight of a replaceable cable cartridge depends on the cable housing and also on the overall length of the cable, which, in some cases, must match the maximum height of the building. Therefore, a heavy replaceable cable cartridge would be rather difficult to handle by; e.g., old, sick and, in general, weak people.

U.S. Pat. No. 6,467,575 discloses a rescue system that is based on a spiral-tube. However, the spiral-tube has to be lowered from the roof of a building using crane equipment that is mounted on top of the roof of the building.

U.S. Pat. No. 6,467,575 discloses a controlled descent device that is based on rotatable drum that is coupled to a centrifugal brake mechanism.

All of the above-mentioned solutions have not provided a satisfactory solution to the problem of ensuring that residents of a tall building are able to timely and conveniently escape the tall building.

It is therefore an object of the present invention to provide an escape kit for ensuring that residents of a tall building would be able to escape the building timely and independently of external rescue services.

It is another object of the present invention to provide an inexpensive escape kit that is very easy to operate by unskilled, or inexperienced, persons.

Other objects and advantages of the invention will become apparent as the description proceeds.

SUMMARY OF THE INVENTION

The present invention provides a personal escaping device for allowing persons escaping high buildings in emergency cases.

The escape device of the present invention comprises a sliding box that is worn by the escaping person and which is combined with an escape cable.

The sliding box comprises:

a) a supporting structure;

b) a driven wheel, supported in said structure, for rotation, the driven wheel being adapted to be in engagement with the escape cable and to be driven thereby into rotation with a rotary speed corresponding to the speed of the motion of the sliding box relative to the escape cable, and therefore corresponding to the speed of descent of the escaping person;

c) means for measuring said rotary speed of said driven wheel and, therefore, said speed of descent of the escaping person; and d) Brake means for slowing the rotation of said driven wheel, and therefore the speed of descent of the escaping person, whenever required to maintain said speed of descent within predetermined limits.

The sliding box preferably comprises engaging means for maintaining the engagement of the driven wheel with the escape cable. The engaging means are preferably one or more wheels.

A harness permitting a person to carry said sliding box is also a part of the escape device of the invention.

At least one escape cable is attached to the building from which escape is provided, at or above the level from which the escape of persons may occur. Preferably, a number of escape cables are provided, to permit the concurrent escape of several persons, and each cable is kept in a wound-up condition, preferably in a container fixed to the building, from which condition it may be unwound when desired by an escaping person. For example, each cable may be wound on a wheel, from which it may be unwound by exerting a moderate pull on its free end.

The driven wheel is preferably a toothed wheel and the escape cable is preferably formed by elements shaped so as to engage the teeth of said wheel and pivoted to one another or strung on a central cable.

The sliding box is preferably provided with a control which receives the measurement of the speed of descent of the escaping person, compares it with a predetermined desired speed, and if it is greater than said desired speed, actuates the aforesaid brake means to reduce it to said desired speed. While said speed of descent is automatically controlled by said control device, emergency brake means are preferably provided, to be actuate by the escaping person, if required.

The engaging means are preferably one or more wheels. According to an aspect of the invention, the engaging means is an option.

Preferably, the elements of the escape cable are made of fire proof and heat-resisting materials, such as ceramic materials, or metal (e.g., light weight aluminum alloy), or a combination thereof, with or without plastic components.

According to an aspect of the invention, some of the elements of the escape cable are anchor elements, each of which is rigidly affixed to the escape cable for preventing excess load on the lower elements, and the spacing between each two anchor elements is predetermined according to preferred distance or preferred number of elements.

The most preferred structures of the escape device, and particularly of the sliding box, will now be described.

According to a first preferred embodiment of the present invention, the control is implemented by a hydraulic system.

According to a first aspect of the first preferred embodiment, the relative motion is controlled by utilizing a counteracting force that is generated for limiting the rotational speed of an oil pump that is mechanically coupled to the driven wheel.

Preferably, the hydraulic system comprises:

1) Oil pump—the rotation axis of which is mechanically coupled to the rotation axis of the driven wheel, for transferring rotational motion, caused by the relative motion, from the driven wheel to the oil pump, and for providing a counteracting force, which is generated by the oil pump in response to the rotational motion, to the driven wheel, for regulating the relative motion. The oil pump includes oil inlet and oil outlet. If the oil outlet is blocked, for some reason, the axis of the oil pump immediately slows down to a speed that depends on the mechanical gap(s), which normally exists between the rotating elements inside the oil pump and the housing of these elements, through which there exists some minimum flow of oil; and 2) Hydraulic control unit—the control unit includes:

oil inlet that is connected to the oil outlet of the oil pump and to an oil passage inside the control unit;

regulating valve, for closing/opening the oil inlet of the hydraulic control unit, for regulating the flow rate of the oil passing through the oil inlet of the control unit, and thereby, the pressure in the oil passage. The regulating valve comprises a piston that is connected to a rod movable through a sealed opening. The piston is movable inside a cylindrical housing, and its position inside the cylindrical housing is determined according to the pressure exerted by a spring on one of its sides, and a pressure exerted on its other side by oil that is contained within the cylinder, through which the piston is movable, and has a free access to the oil passage;

valve, for determining the amount and rate of oil that enters the cylindrical housing of the regulating valve;

accumulator, which comprises a piston that is connected to a rod movable through a sealed opening. The piston is movable inside a cylindrical oil reservoir, which is connected to the oil passage, and its position in the cylinder is determined according to the pressure exerted by a spring on one of its sides, and a pressure exerted on its other side by the oil contained within the oil reservoir. The rods of the accumulator and regulating valve are mechanically coupled to one another in a way that whenever the rod of the regulating valve moves to close the oil inlet of the control unit, the rod (and therefore the piston) of the accumulator is moved in a way that oil from the cylindrical oil reservoir is pushed, via the oil passage, to fill the additional volume that is created by the movement of the rod of the regulating valve. The oil reservoir allows changes in the oil passage while a relative motion is being regulated;

oil outlet that is connected to the oil inlet of the oil pump; and adjustable valve, for allowing changing the flow rate threshold of oil that returns to the oil pump through the oil outlet of the control unit.

According to a second aspect of the first preferred embodiment, the relative motion is controlled by utilizing a brake force that is employed directly on the driven wheel by a hydraulic braking piston, and the oil pressure release (i.e., which causes the brake force to decrease) is implemented by utilization of hydraulic needle valve.

Preferably, the hydraulic system comprises, according to the second aspect:

1) Oil pump—the rotation axis of which is mechanically coupled to the rotation axis of the driven wheel, for transferring rotational motion caused by the relative motion from the driven wheel to the oil pump. The oil pump includes oil inlet and oil outlet;

2) Hydraulic control unit—the control unit includes:

oil inlet that is connected to the oil outlet of the oil pump and to an oil passage inside the hydraulic control unit; and Oil outlet that is connected to the oil inlet of the oil pump and to an oil reservoir inside the hydraulic unit;

hydraulic needle valve, for closing/opening the oil passage inside the hydraulic control unit, for regulating the flow rate of the oil passing between the oil inlet and the oil outlet of the control unit, and thereby, the pressure in the oil passage. The hydraulic needle valve comprises a piston that is connected to a needle-like rod that is movable through a sealed opening. The piston is movable inside a cylindrical housing of the hydraulic needle valve, and its position inside the cylindrical housing is determined according to the pressure exerted by a spring on one of its sides, and a pressure exerted on its other side by oil that is contained within the cylinder, through which the piston is movable, and has a free access to the oil passage;

Braking cylinder, which comprises a piston that is connected to a rod movable through a sealed opening. The position of the piston is determined according to a first force exerted on one side of the piston by a spring, and a second force that counteracts the first force and is exerted on the other side of the piston by the oil pressure existing in the oil passage. One end of the movable rod is connected to the piston, and the other end of the rod is connected to a rubbing strip. The piston of the braking cylinder is pushed outwards (i.e., with respect to the hydraulic control unit) whenever the pressure in the oil passage increases as a result of an increase in the relative motion, thereby pushing said rubbing strip against the driven wheel, for providing counteracting, or braking, force that will limit the increase in the relative motion. The pressure increase in the oil passage pushes outwards also the piston of the hydraulic needle valve, thereby causing the oil passage between the oil inlet and oil outlet to open, for allowing reducing the relatively high pressure in the oil passage, after which the braking force, which is employed on the driven wheel by the rubbing strip, is reduced, or weakened; and Accumulator, which comprises a piston that is connected to a rod movable through a sealed opening. The piston is movable inside a cylindrical oil reservoir, which is connected to the oil outlet end of the hydraulic control unit, and its position in the cylinder is determined according to the pressure exerted by a spring on one of its sides, and a pressure exerted on its other side by the oil contained within the oil reservoir.

According to a second preferred embodiment of the present invention, the control is implemented by an electrical system, in which the relative motion is regulated by a counteracting force that is generated by use of electrical motor.

Preferably, the electrical system comprises:

1) Speed sensor, for monitoring the rotational speed of the driven wheel, and thereby, the descend speed. The speed sensor is capable of generating an electrical signal that represents the rotational speed (i.e., rpm) of the driven wheel;
2) Electric motor, on the rotation axis of which is coupled the driven wheel, and in which a first magnetic field is induced by the rotation of the driven wheel. The aforesaid rotation and induced current represent the descend speed;
3) Electronic control unit, for accepting the electrical signals and outputting a corresponding electrical signal to the electric motor in a way that the latter corresponding signal generates in the electric motor a second magnetic field that essentially counteracts the first magnetic field, thereby providing the required counteracting force; and
4) Battery pack, for powering the speed sensor, electric control unit, and for providing the electrical signal required for generation of the second magnetic field.

According to a third preferred embodiment of the present invention, the counteracting force generating system is an electromechanical system, in which the relative motion is controlled by utilizing a brake force that is employed directly on the driven wheel by a hydraulic braking piston, and the oil pressure release (i.e., which causes the brake force to decrease), is implemented by utilization of electromechanical needle valve.

Preferably, the electromechanical brake system comprises:

1) Speed sensor, for monitoring the rotational speed of the driven wheel, and thereby, the descend speed. The speed sensor is capable of generating a electrical signal that represents the rotational speed (i.e., rpm) of the driven wheel;
2) Oil pump—the rotation axis of which is mechanically coupled to the rotation axis of the driven wheel, for transferring rotational motion caused by the relative motion from the driven wheel to the oil pump. The oil pump includes oil inlet and oil outlet;
3) Hydraulic control unit—the hydraulic control unit includes:
   - oil inlet that is connected to the oil outlet of the oil pump and to an oil passage inside the hydraulic control unit;
   - Oil outlet that is connected to the oil inlet of the oil pump and to an oil reservoir inside the hydraulic unit;
   - Electro-mechanical needle valve, for closing/opening the oil passage inside the hydraulic control unit, for regulating the flow rate of the oil passing between the oil inlet and the oil outlet of the hydraulic control unit, and thereby, the pressure in the oil passage. The electromechanical needle valve comprises an electrical portion capable of translating electric signals into physical positioning of a needle-like rod that is movable through a sealed opening;
   - Braking cylinder, which comprises a piston that is connected to a rod movable through a sealed opening. The position of the piston is determined according to a first force exerted on one side of the piston by a spring, and a second force that (opposes the first force and) is exerted on the other side of the piston by the oil pressure existing in the oil passage. One end of the movable rod is connected to the piston, and the other end of the rod is connected to a rubbing strip. The piston of the braking cylinder is pushed outwards (i.e., with respect to the hydraulic control unit) whenever the pressure in the oil passage increases as a result of an increase in the relative motion, for providing counteracting force that will limit the increase in the relative motion. Whenever required, the passage between the oil inlet and oil outlet is opened, by retracting the electromechanical needle valve, for allowing reducing relatively high pressure in the oil passage, after which the braking force, which is employed on the driven wheel by the rubbing strip, will ease, or cease;
   - Accumulator, which comprises a piston that is connected to a rod movable through a sealed opening. The piston is movable inside a cylindrical oil reservoir, which is connected to the oil outlet end of the hydraulic control unit, and its position in the cylinder is determined according to the pressure exerted by a spring on one of its sides, and a pressure exerted on its other side by the oil contained within the oil reservoir. The oil reservoir allows changes in the oil passage while a relative motion is being regulated;
4) Electronic control unit, for accepting the electrical signals and outputting a corresponding signal to the electromechanical needle valve, for regulating the braking force employed on the driven wheel; and
5) Battery pack, for powering the speed sensor, electronic control unit and the electromechanical needle valve.

According to an aspect of the present invention, the rubbing strip is further connected to a mechanical emergency braking arrangement, which comprises a screw-like rod, handle, nut, bearing, lever, pivot and mechanical arrangement that keeps the screw-like rod in a fixed longitudinal position with respect to the sliding box. Screw-like rod is screwable through the nut, to which a bearing is mechanically affixed. The screw-like rod is intended to be rotated by a person utilizing the sliding box for descending, by operating the handle. When the screw-like rod is rotated in the corresponding direction, nut, and therefore bearing that is affixed thereto, advance, along the screw-like rod, such that the bearing slides on the lever. Since the right end of the lever (i.e., according to this example) is rotatable around the fixed pivot, the movement of the bearing to the left-hand side direction causes the rubbing strip, which is affixed to the distal end of the lever, to push one side of the driven wheel, and, thereby, to provide a brake force for slowing the driven wheel, or, if so required, for slowing the driven wheel until the driven wheel, and therefore, the sliding box, is completely stopped.

Optionally, moving bearing to the extreme left-hand side of lever results in sustaining some predetermined minimal down-motion of the sliding box with respect to the escape cable.

According to another preferred embodiment of the present invention, there is provided means for connecting a descending person to an escape cable, and the sliding boxes is rigidly affixed to strategic place, for example, to an outer side of a wall of a building, and the escape cable is allowed to slide down along the wall of the building.

BRIEF DESCRIPTION OF THE DRAWINGS

The above and other characteristics and advantages of the invention will be better understood through the following illustrative and non-limitative detailed description of preferred embodiments thereof, with reference to the appended drawings, wherein.

DETAILED DESCRIPTION OF PREFERRED EMBODIMENTS

Figure 1:
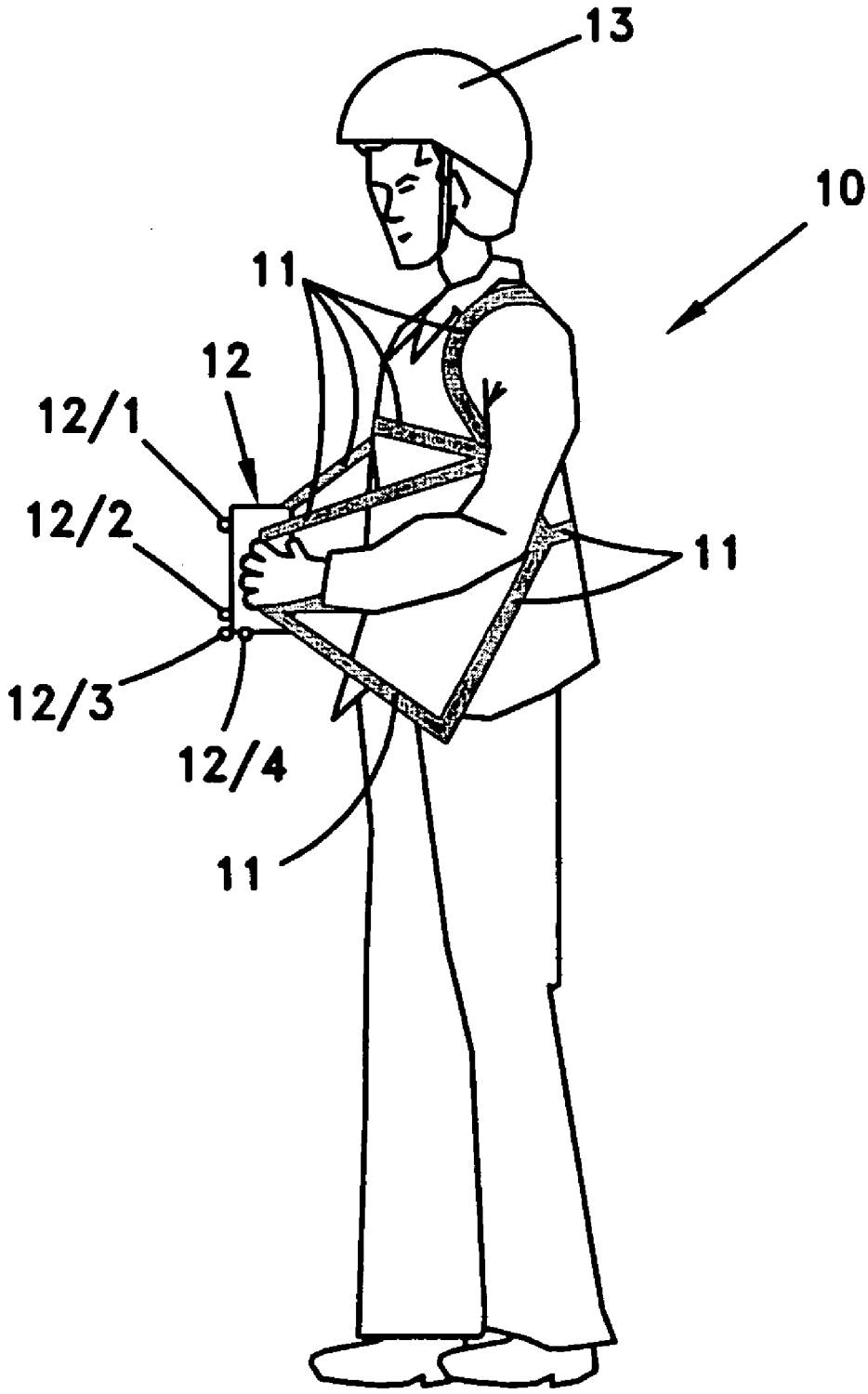
FIG. 1 schematically illustrates a person wearing a flexible harness, according to a preferred embodiment of the present invention.

FIG. 1 schematically illustrates a person wearing an escape kit that comprises a flexible harness and a sliding box, according to a preferred embodiment of the invention. The escape kit comprises harness 11, which person 10 is wearing, and sliding box 12, which is firmly affixed to harness 11. Optionally, the escape kit may comprise helmet 13, which may, or may not, carry a spotlight/flashlight. Harness 11, which is constructed from several belts is capable of supporting at least 250 Kgs. Sliding box 12 includes, on its external face, several rounded wheels 12/1 to 12/4, for allowing sliding box 12 to slide down along a wall (e.g., of a building).

Figure 2:
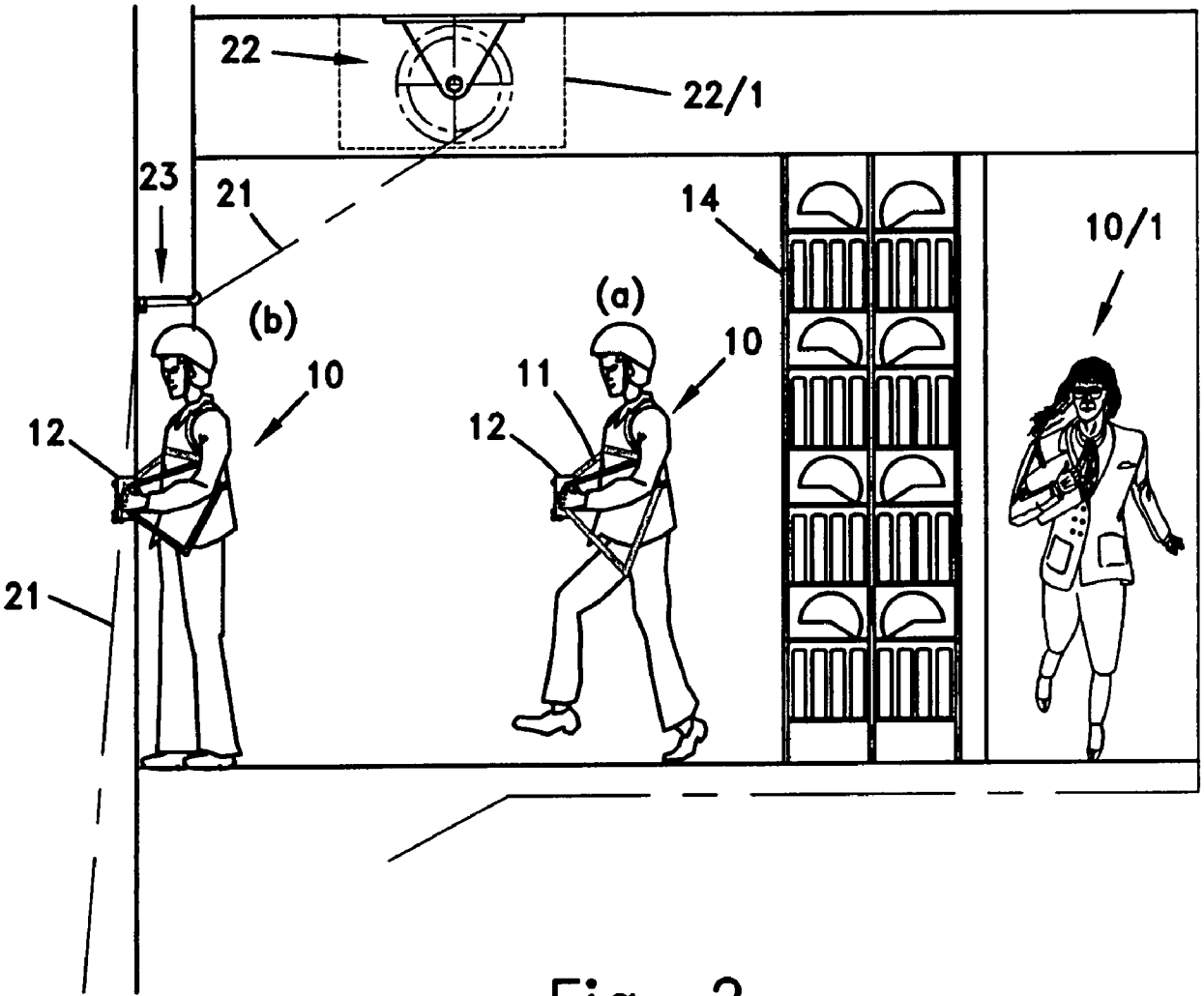
FIGS. 2*a* to 2*c* schematically illustrate the basic steps of escaping a building, according to a preferred embodiment of the present invention.
Figure 2:
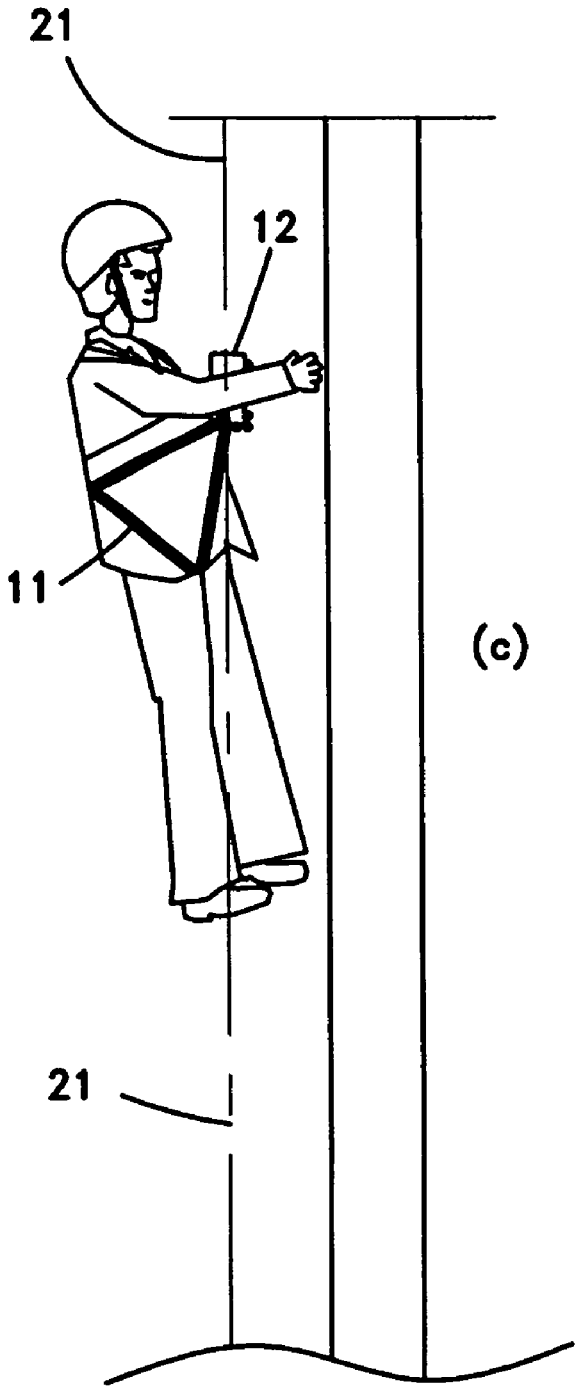

FIGS. 2*a* to 2*c* schematically illustrate the basic steps of escaping a building, according to a preferred embodiment of the invention. Escape cable 21 is normally (i.e., when not in use) winded over winch drum (22), ready to be used in cases of emergencies. A first end of escape cable 21 is firmly affixed to winch 22, and the second end of winch 22 is a throwing end that is intended to be thrown by a person outside an escaping window or hatch. Winch (22), together with the escape cable 21 winded there upon, could be hidden inside some sort of a closet (generally indicated by reference numeral 22/1), for aesthetic purpose, and its location could be predetermined according to preferred strategy. For example, the location of winch 22 could be chosen in a way that escape cable 21 would pass as close to as many windows of the building as possible (that is, on its way down). Of course, any aesthetic arrangement of winch 22 must allow easy access to, and convenient operation of, escape cable (21). Several winches, such as winch 22, and several escape cables such as cable 21 might be located in several strategic locations with respect to a building, for ensuring, in cases of emergencies, safe and fast rescue of the building residents.

Referring to FIG. 2*a*, after the escaping person 10 wears its escape kit, which comprise at least harness 11 and sliding box 12, escaping person 10 approaches closet 22/1, opens the closet, grabs the throwing end of escape cable 21, and starts unwinding escape cable 21 from winch 22. Then, person 10 approaches the escape window, or hatch, and continues to unwind escape cable 21 through the escape window/hatch, until escape cable 21 is completely unwounded. Next (see FIG. 2*b*), person 10 opens sliding box 12, inserts escape cable 21 into sliding box 12, locks and secures sliding box 12 with the escape cable inside, and moves his body beyond the threshold of the escape window/hatch. Then, person 10 turns around so that his face is against the escape window and starts sliding down (see FIG. 2*c*). Of course, additional persons might utilize escape cable 21 for escaping. For example, woman 10/1 could fetch her escape kit from closet 14, and perform the required escaping procedure, except that in the cases of other escaping persons, there would be no need to uncoil escape cable 21, as this cable was previously uncoiled by the first escaping person. One or more closets, such as closet 14, could be deployed in every floor of a building. Escape cable 21 could be coiled again, if desired, by operating winch 22, provided, of course, that the emergency case no longer exists and the conditions (i.e., of the building, escape cable, winch, etc.) allow it.

Figure 3:
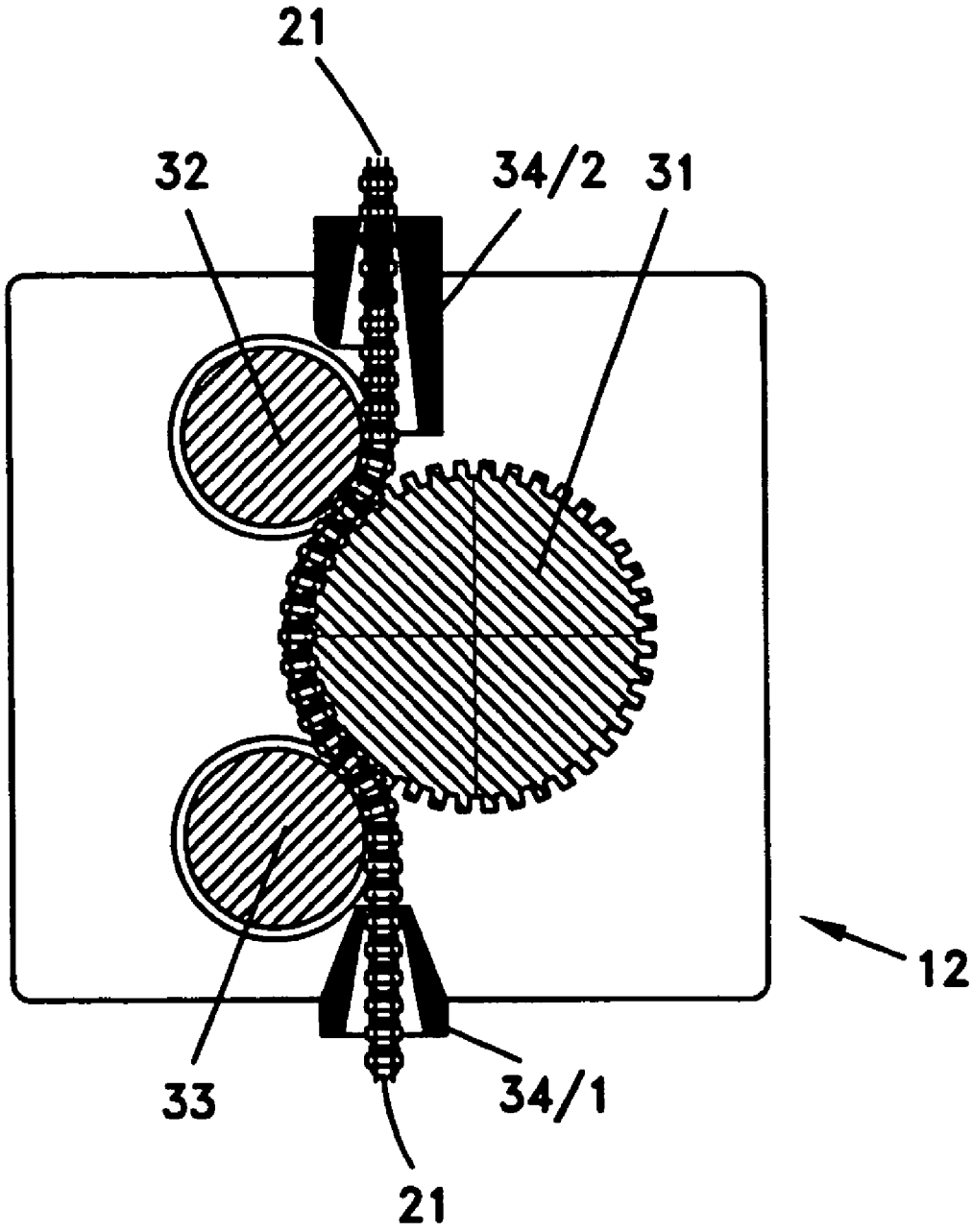
FIG. 3 shows the transmission section of the sliding box, according to a preferred embodiment of the present invention.

FIG. 3 depicts one cross section of the sliding box, according to one preferred embodiment of the invention. Sliding box 12 comprises, in general, two sections. One section, which is shown in FIG. 3, includes engaging means for keeping escape cable 21 in a velocity-controlling route within sliding box 12, for allowing sensing the relative velocity of sliding box 12 with respect to escape cable 21 (i.e., sensing the descending rate of sliding box 12). The function of guiding elements 34/1 and 34/2 is to allow safe/smooth entry and exit of cable 21 into/from sliding box 12, respectively. The function of main pulley 31, which is, according to this example, the driven wheel, is sensing the relative velocity between sliding box 12 and cable 21, for allowing a second section of sliding box 12 (not shown) to generate a counter pressure, or momentum, in response to the sensed velocity difference, for controlling the velocity of sliding box 12 while descending along cable 21. Pulley 31 is a toothed wheel that includes a plurality of 'teeth' that form a contour line that essentially counter matches the unique shape/design of the elements of escape cable 21 shown in FIGS. 4*a* and 4*b*. The dimensions of the teeth and the spacing therebetween provide adequate coupling between pulley 31 and escape cable 21 even in cases where the distance between adjacent connecting elements 40 might slightly change for any reason, for example when a heavy person slides down along escape cable 21 exerting considerable force on the connecting elements. The function of pulleys 32 and 33 is to assure engagement of escape cable 21 to main pulley 31. Preferably, there are two secondary pulleys (32 and 33). However, any suitable number of secondary pulleys, or some other engaging arrangement (i.e., between escape cable 21 and the driven wheel, in this case main pulley 31), might be utilized instead. According to an aspect of the present invention, the secondary pulleys are optional.

Figure 4A:
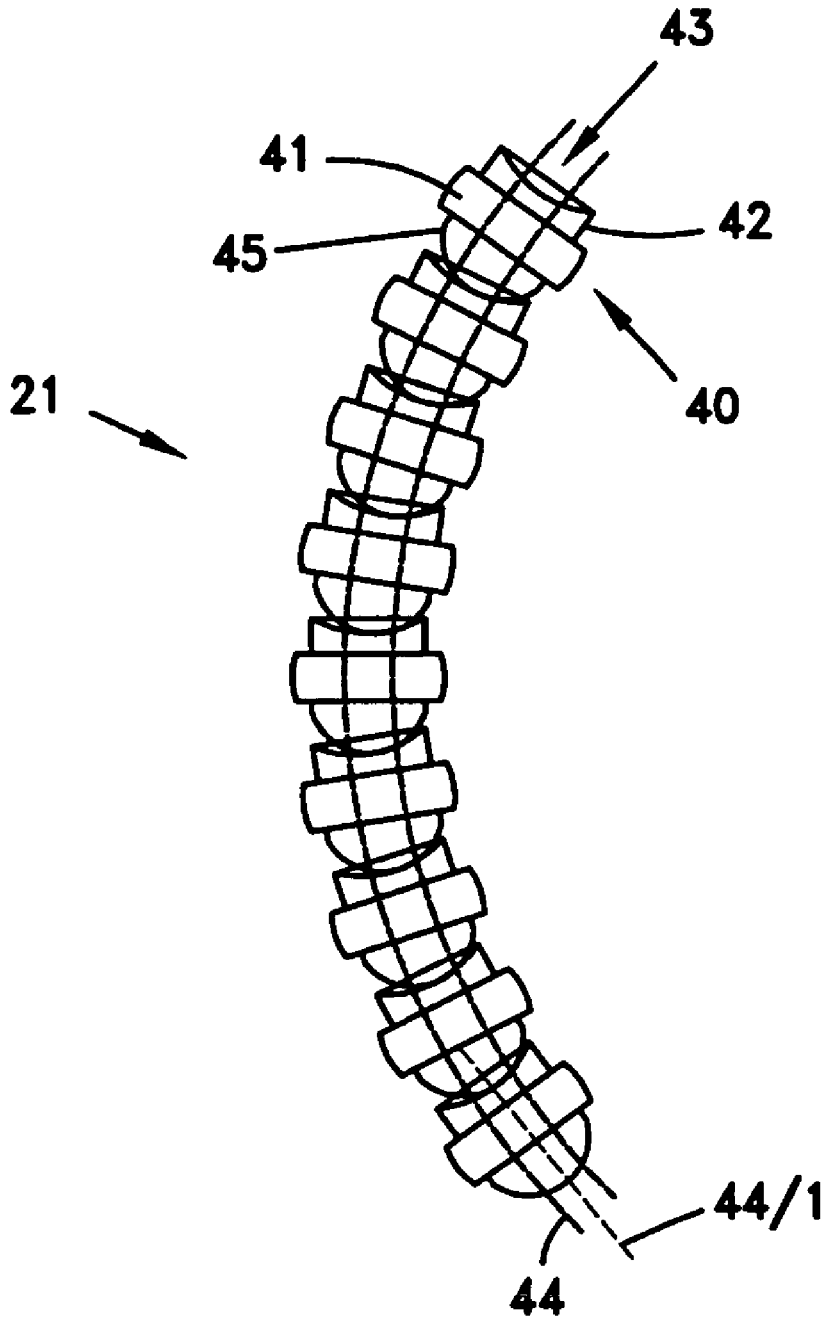
FIGS. 4*a* and 4*b* show sketches of the cable and its dimensions, according to an aspect of the present invention.

Referring to FIG. 4*a*, cable 21 (only a portion of it is shown) comprises a plurality of elements, such as element 40, and flexible cable 44. Each one of the elements has a central cylindrical bore hole through which flexible cable 44 passes. Each one of the elements includes a first cylinder 42 and a second cylinder 41 which has essentially the shape of a disc. First and second cylinders 41 and 42 have a common longitudinal axis 44/1. Cylinder 41 has a diameter larger than that of the cylinder 42, and is located essentially in the central portion of the perimeter of cylinder 42. One end of cylinder 42 has essentially the shape of a convex 45, and the opposite end of cylinder 42 has essentially the shape of a concave 43. The convex of each one of a elements is brought in contact with the concave of the next element, and so on, and the concave and convex portions of the elements allow utilizing the flexibility of escape cable 21, which might be helpful also in cases where an escaping person whishes to bypass obstacles while descending from a high building The function of cylinders 41 is to prevent any sliding between the sliding box 12 and the escape cable 21, and relay the descending velocity to toothed wheel 31 and wheels 32 and 33 (see FIG. 3), thereby allowing sliding box 12 to control its descend rate along escape cable 21.

Whenever escape cable 21 is essentially in vertical position (i.e., as it would be normally the case when utilized for escaping from tall places), each one of elements 40 exerts pressure on the elements below it. The resulting pressure on specific element 40 will be, therefore, a function of the accumulative mass of the elements 40 above that specific element, and of the weight of the sliding box and sliding person. Consequently, the lowermost elements of the escape cable will be under high pressure, which might result in rupturing the escape cable.

In order to avoid exerting too much pressure on the lowermost elements of escape cable 21, an element 46 (herein "anchor element") will be firmly affixed to the flexible cable 44 (FIG. 4*a*) each predefined distance or number of elements. For example, one element could be firmly affixed to the cable each five meters, or each 30 elements. This way, the maximum pressure that would be exerted on an element just above an anchor element will be limited to the pressure exerted by the remaining elements existing between the corresponding anchor elements, plus the weight of the sliding box and person. Referring to the example shown in FIG. 4*c*, an anchor element 46 is affixed to flexible cable 44 each three 'ordinary' elements 40. The elements 40 allow rolling the escape cable on a roller, or cylindrical drum, the diameter of which could be, e.g., 0.6 meter, for allowing convenient and aesthetic storage of the escape cable inside a closet whenever the escape cable is not in use, and fast deployment, or unwinding, of the escape cable in cases of emergencies. The closet could be conveniently installed at a desirable location on the preferred floor.

Figure 4B:
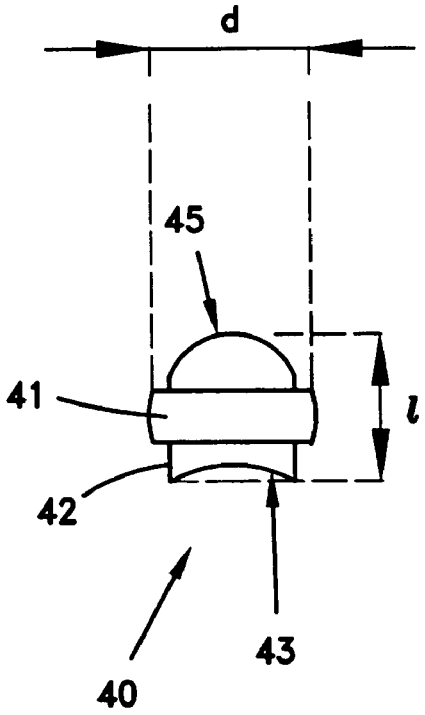
Figure 4C:
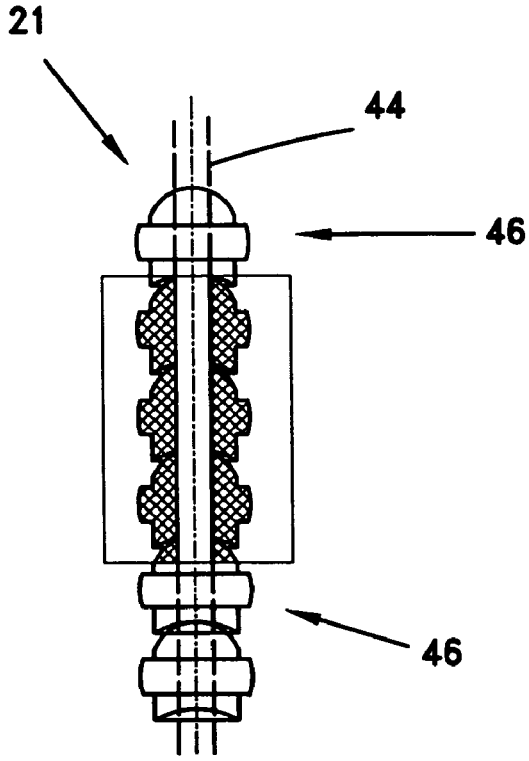
Figure 13:
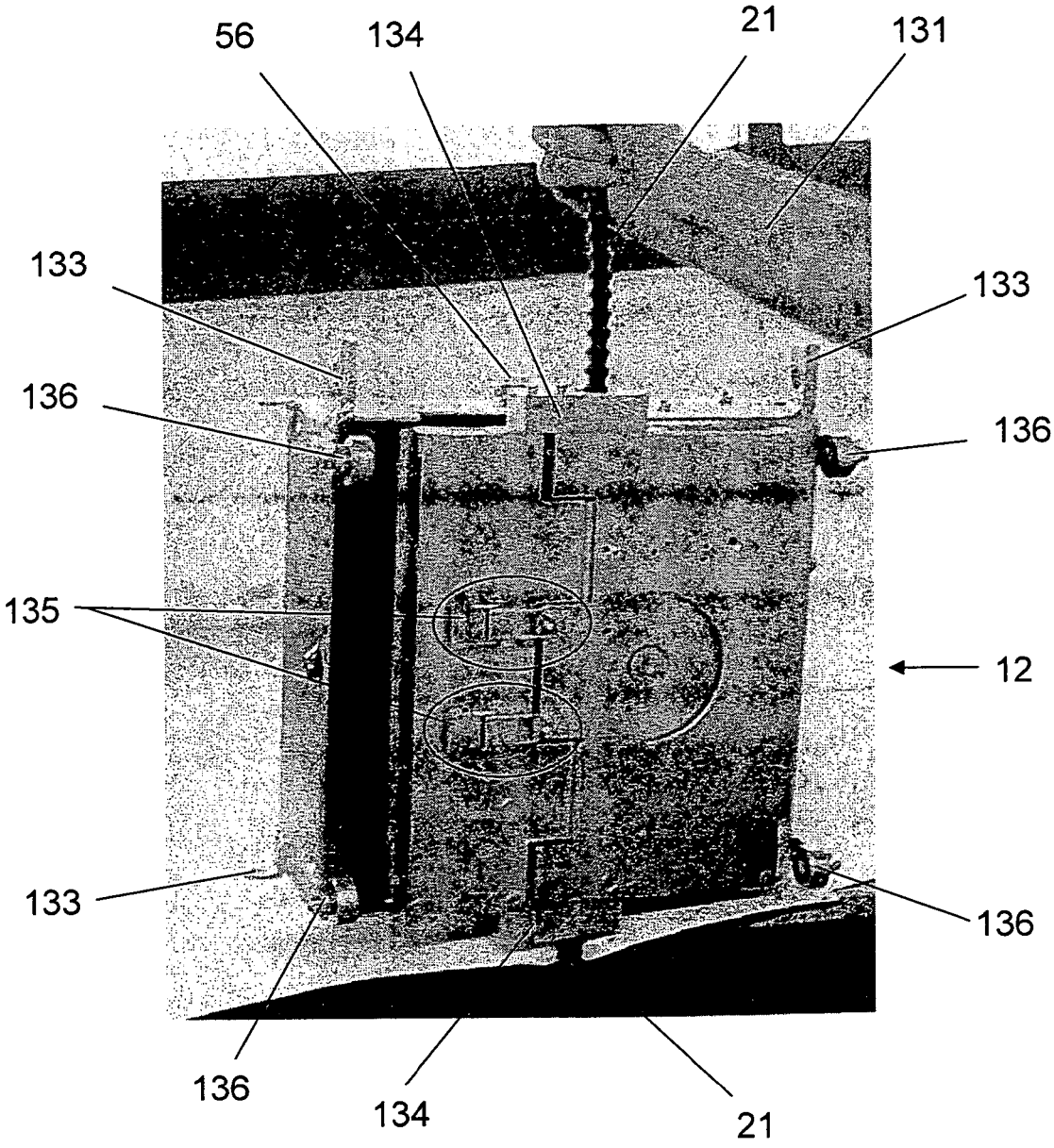
FIG. 13 shows the proportion between a person's hand palm and an exemplary sliding box and escape cable, according to the present invention.

Referring to FIGS. 4*b* and 13, an exemplary dimensions of the connecting elements are l=18 millimeters ('l'—length of individual element), and d=15 millimeters ('d'—the diameter of the larger cylinder 41). These dimensions can change from one type of a sliding box to another.

Figure 5C:
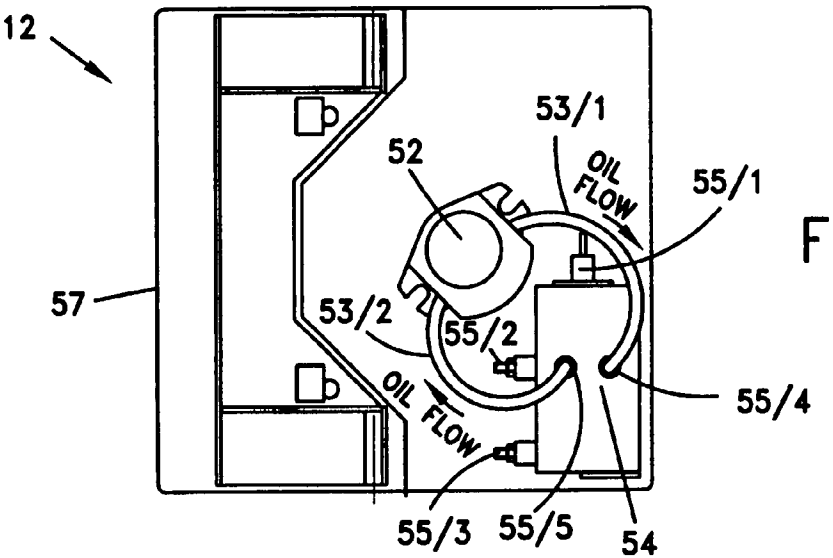
FIG. 5*c* shows an external view of the sliding box, according to a preferred embodiment of the present invention.
Figure 5B:
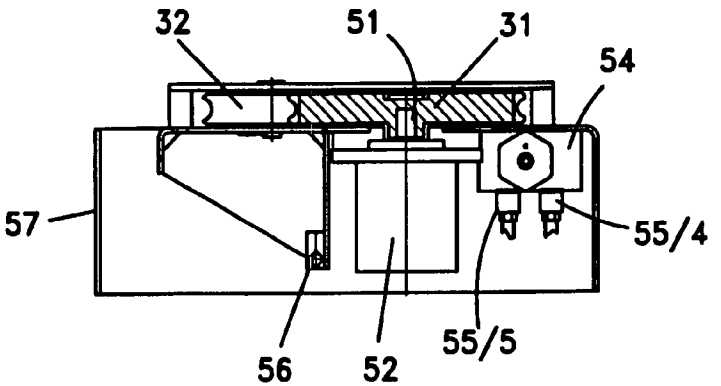
FIGS. 5*a* and 5*b* show the sliding box in its "open" and "close" state, respectively, according to a preferred embodiment of the present invention.
Figure 5A:
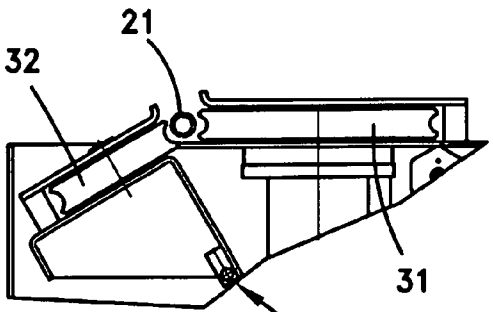

FIGS. 5*a* and 5*b* schematically illustrate sliding box 12 in "open" and "closed" positions, respectively. In FIG. 5*a*, sliding box 12 is opened in a way that main pulley 31 (i.e., the driven wheel) is separated from secondary pulleys 32 and 33 (pulley 33 not shown) for making room for cable 21, which is arranged therebetween as shown in FIG. 3. After placing cable 21 between the pulleys 31 and 32/33, sliding box 12 is then closed, thereby securing the passage of cable 21 therein; i.e., by pressing cable 21 against main pulley 31 by secondary pulleys 32 and 33 (FIG. 5*b*). Reference numeral 56 denotes a pivot axis around which sliding box 12 is opened/closed. Reference numeral 57 denotes the supporting structure to which the driven wheel (i.e., according to this example main pulley 31), the engaging means (i.e., according to this example secondary pulleys 32 and 33), and the means for measuring the rotary speed of the driven wheel and providing the required brake force for slowing the rotation of the driven wheel (i.e., according to this example oil pump 52 and hydraulic control unit 54) are rigidly affixed.

Referring to FIGS. 5*b* and 5*c*, whenever sliding box 12 descends along cable 21, pulleys 31 to 33 rotate at an angular velocity corresponding to the descending rate. Pulley 31 is mechanically coupled to oil pump 52 (i.e., by means of driveshaft 51) that is part of the hydraulic system that is contained within sliding box 12. Therefore, the rotational movement of pulley 31 is transferred to the axis of a "toothed wheel" type oil pump 52. The rate of the angular velocity of the oil pump, and therefore, the angular velocity of main pulley 31 (and also the descend rate), is controlled by ("weight/velocity") hydraulic control unit 54, which regulates the oil circulation in the hydraulic system. Hydraulic control unit 54 includes oil inlet 55/4, which is connected by means of pipe 53/1 to the oil outlet of oil pump 52, and oil outlet 55/5, which is connected by means of pipe 53/2 to the oil inlet of oil pump 52.

The rate of oil flow, which enters control unit 54 through oil inlet 55/4, is adjusted by a regulating valve that is implemented by an oil piston arrangement, in a way that is described herein below in connection with FIG. 6*c*. Likewise, the oil flow rate that returns to oil pump 52 (i.e., from outlet 55/5) is controlled by an adjustable needle valve 55/2. Reference numeral 55/1 denotes an oil accumulator, the task of which is to compensate for variations in the oil pressure within the (closed) hydraulic system; the pressure variations being caused by changes in the angular momentum that is exerted on the axis of oil pump 52 as a result of the descending sliding box 12. Control unit 54 includes additional needle valve 55/3 for regulating the extent of the aforesaid compensation (i.e., of oil pressure).

Figure 6A:
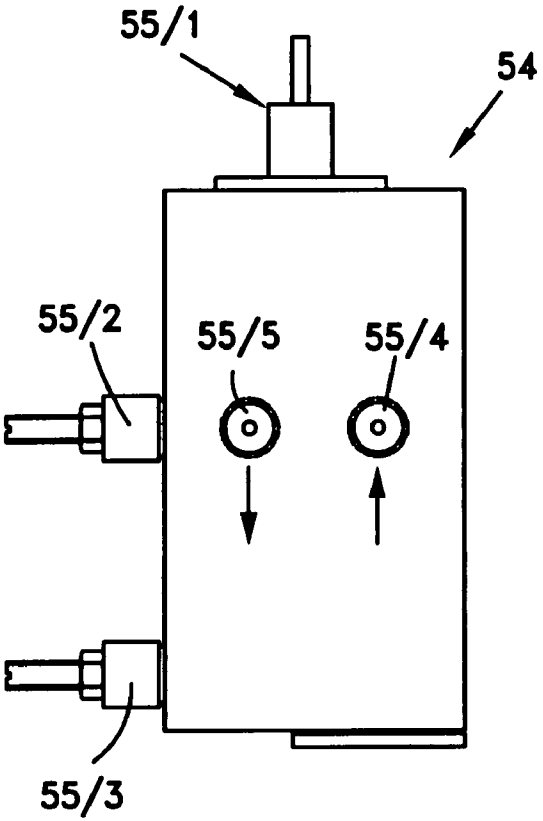
FIGS. 6*a* and 6*b* show in separate the control unit of the sliding box and a side view thereof, respectively, according to a preferred embodiment of the present invention.
Figure 6B:
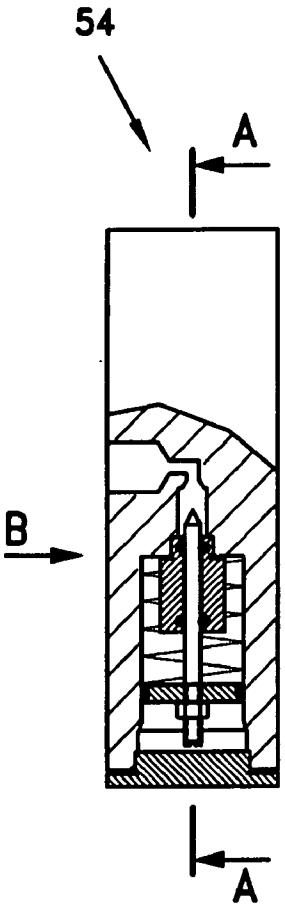

FIG. 6*a* shows a general and isolated view of the control unit shown in FIG. 5*b*, and FIG. 6*b* shows a side view of control unit 54.

Figure 6C:
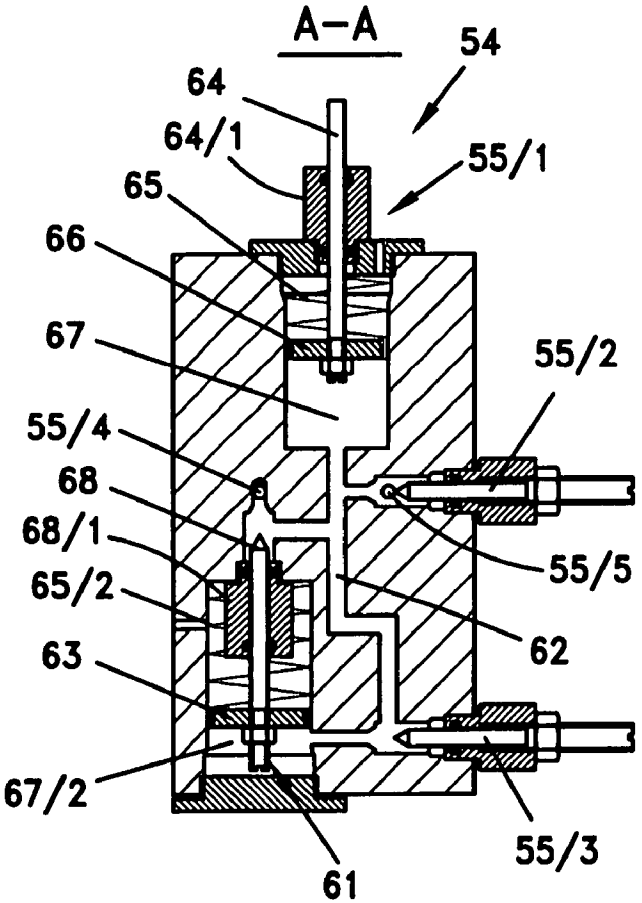
FIG. 6*c* schematically illustrates the inner components of the control unit, according to a preferred embodiment of the present invention.

FIG. 6*c* is an A-A cross-section of FIG. 6*b*. Oil accumulator 55/1 comprises piston 66 to which piston rod 64 is connected, member 64/1, through which piston rode 64 is freely slidable, spring 65 and oil reservoir 67. The position of piston 66 (i.e., within the cylinder in which it is moveable), at any given time, depends on the mechanical characteristics of spring 65, on the area of piston 66 and on the instantaneous oil pressure residing within the oil reservoir (67). Put otherwise, the final position of piston 66 will be such that equilibrium will exist between the force exerted by spring 65 on one side of piston 66 and the force exerted by the oil pressure on the other side of piston 66.

Likewise, regulating valve 61 comprises piston 63 to which piston rod 68 is connected, member 68/1, through which piston rod 68 is freely moveable, spring 65/2 and oil reservoir 67/2. The position of piston 63 (i.e., within the cylinder in which it is moveable), at any given time, depends on the mechanical characteristics of spring 65/2, on the area of piston 63 and on the instantaneous oil pressure residing within the oil reservoir (67/2). Put otherwise, the final position of piston 63 will be such that an equilibrium will exist between the force exerted by spring 65/2 on one side of piston 63 and the force exerted by the oil pressure on the other side of piston 63.

The task of springs 65 and 65/2 is to keep pistons 66 and 63, respectively, at some initial position whenever there is no pressure in oil passage 62 (i.e., oil pump 52 is inactive).

The way of controlling the descending rate will be described immediately below. While sliding box 12 is at rest (i.e., no rotational moment is applied to pulley 31), there is no oil circulation in the system (i.e., oil pump 52 is at rest) and no oil pressure is built in oil passage 62 inside control unit 54. However, as a person wearing a sliding box such as sliding box 12 starts descending along cable 21, pulley 31 starts rotating and the rotational moment is transferred to oil pump 52 (FIG. 5*b* or 5*c*), which, in turn, starts pushing oil into control unit 54 through inlet 55/4 of control unit 54. Needle valve 55/2 is adjusted such that a the oil flow rate through inlet valve 55/4 is higher than the oil flow rate through outlet valve 55/5. Consequently, the pressure in oil passage 62 increases, causing piston 63 to move towards inlet 55/4, for reducing the oil flow rate through inlet 55/4. Since the hydraulic system is a closed system (i.e., there is a fixed amount of oil in the hydraulic system), enlarging volume 67/2 is allowed because the additional oil in volume 67/2 comes from volume 67. The latter feature is possible, because rods 64 and 68 are mechanically coupled to one another in a way that each "up" movement of piston 63 is followed by a counter "down" movement of piston 66, and vice versa. This way, every increase in volume 67/2 is followed by a corresponding decrease in the volume 67, and vice versa, meaning that oil is exchanged between volume 67 to volume 67/2.

At the same time the increased oil pressure in passage 62 causes piston 63 to move towards inlet 55/4 for reducing the flow rate of oil coming from oil pump 52, oil pump 52 continues sucking oil through outlet 55/5, and, therefore, the pressure in oil passage 62 decreases, thereby causing piston 63 to open inlet 55/4 (i.e., by use of spring 65/2) and oil pump 52 to inject oil there through at an increased flow rate, which results in an increase in the pressure in oil passage 62. As long as force is exerted on oil pump 52 by pulley 31, piston 63 will repetitively close and open inlet 55/4, in a cyclic manner, wherein each cycle includes one "open" (or "closed") state (i.e., of inlet 55/4) that is followed by one "close" (or "open") state.

The heavier the descending person, the more frequent inlet 55/4 will open and close, because the force exerted on oil pump 52 will be greater, causing a rapid increase in the oil pressure in oil passage 62, which will cause, in turn, inlet 55/4 to rapidly close. The moment inlet 55/4 closes, there will be a rapid decrease in the oil pressure in oil passage 62, which will cause inlet 55/4 to rapidly open, and so on. The changes in the increase and decrease rates in the pressure in oil passage 62 (i.e., in response to changes in the descending person) allow, therefore, maintaining essentially the same descending velocity, regardless of the weight of the descending person. Put otherwise, load changes on pulley 31 will be translated into corresponding changes in the frequency of the "open" and "close" states of inlet 55/4.

Of course, the descending velocity may be set as desired (e.g., 2 meter/second), by adjusting needle valves 55/2 and 55/3, as well as by using springs 65 and 65/2 with different mechanical characteristics, and/or by changing the absolute diameter of pistons 63 and 66 or the ratio therebetween. Valves 55/2 and 55/3 are utilized only for testing and calibration purposes, after which they are permanently set.

Of course, for some cases sliding box 12 could be fixed to a point of a building, or elsewhere, and the cable sliding therein, though the above described embodiment would be preferable.

Figure 7B:
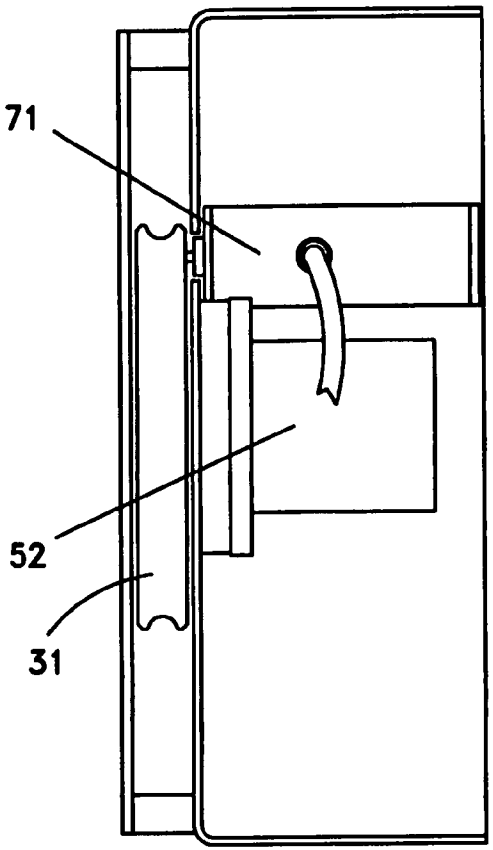
FIGS. 7*a* and 7*b* show mechanical emergency brake system, according to an embodiment of the present invention.
Figure 7A:
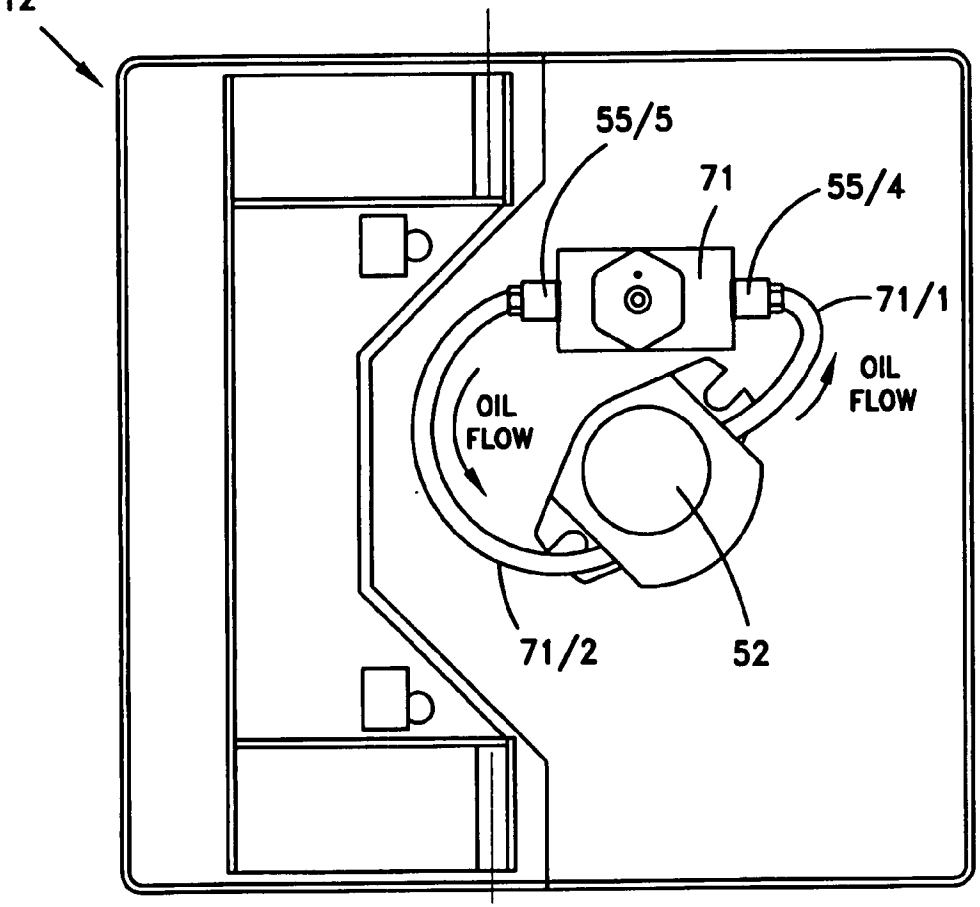

FIGS. 7*a* and 7*b* schematically illustrate a sliding box with automatic hydraulic brake system, according to one preferred embodiment of the present invention. Whenever pulley 31 rotates, oil pump 52 pushes oil to oil inlet 55/4 of speed control unit 71 (i.e., via pipe 71/1). Oil returns from outlet 55/5 of speed control unit 71 to oil pump 52 (i.e., via pipe 71/2).

Figure 8B:
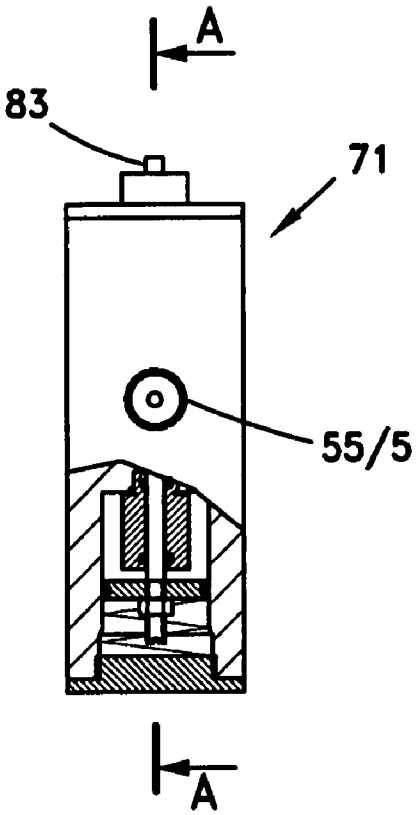
FIGS. 8*a* and 8*b* show in more details the internal structure of the mechanical speed control unit 71 shown in FIGS. 7*a* and 7*b;*
Figure 8A:
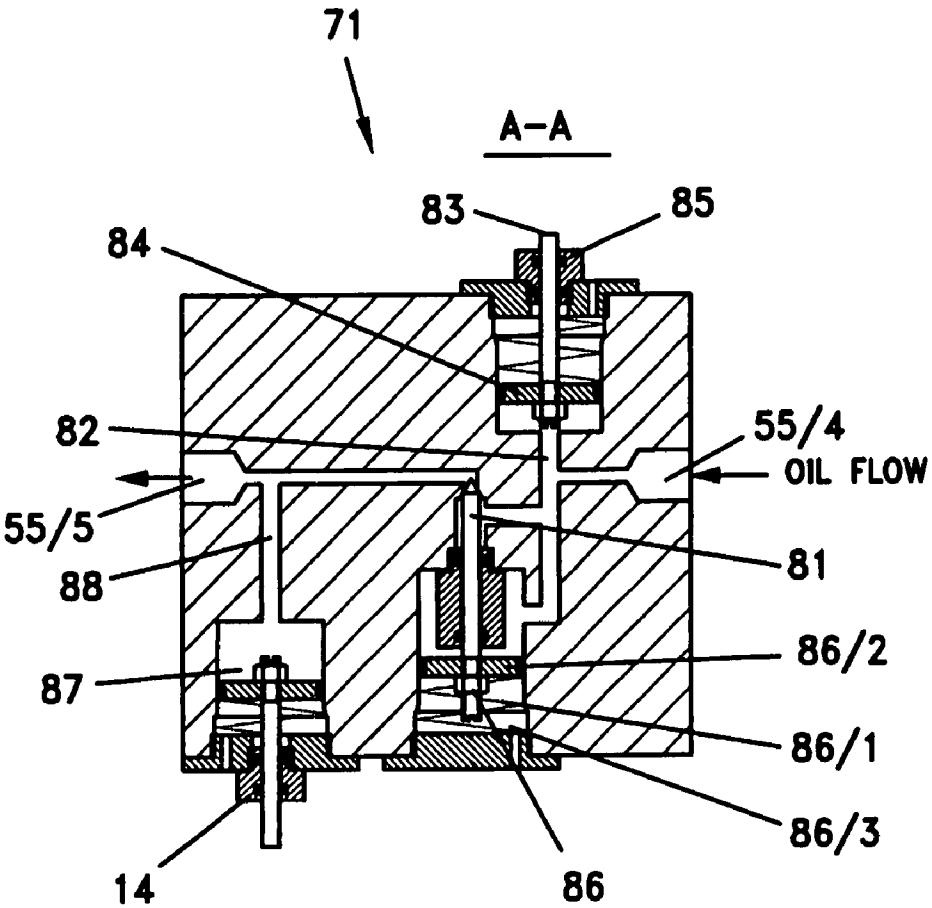

FIGS. 8*a* and 8*b* show in more details the internal structure of the mechanical speed control unit 71 shown in FIGS. 7*a* and 7*b*. Oil is pushed by oil pump 52 (FIG. 7*a*, for example) through inlet 55/4. Needle valve 81 closes oil outlet 55/5, in which case a pressure is formed, by the oil that is pushed through inlet 55/4, which causes piston 84 to move upwards, thereby moving also a rod, the end 83 of which exerts braking force on pulley 31 (i.e., by applying friction to pulley 31) for slowing down the rotational speed of pulley 31. With the increasing pressure inside oil passage 82, and after piston 85 applies friction to pulley 31, there is a pressure threshold above which the oil pressure inside oil passage 82 overcomes the force exerted on piston 86/2 by spring 86/1. Therefore, piston 86/2 starts moving downwards, thereby opening outlet 55/5 and releasing some of the oil pressure locked inside oil passage 82. As a result of the decreasing pressure in oil passage 82, friction end 83 retracts, and the braking friction applied on pulley 31 is removed. The oil pressure decreases in the oil passage 82 until it gets lower than the force exerted on piston 86/2 by spring 86/1, in which case springs 86/1 overcomes the aforesaid oil pressure and moves, once again, piston 86/2 upwards, so that needle valve 81 closes again oil outlet 55/5, after which the oil pressure in oil passage 82 increases again, thereby causing friction end 83 to apply, again, a friction against pulley 31, and so on. In other words, pressure is built up in oil passage 82 as a result of an increase in the rotational speed (RPM) of the oil pump, caused by increased relative motion between the escape cable (21) and the sliding box (12), and the built up oil pressure generates a braking moment that is exerted on the main pulley (31) for reducing the aforesaid relative motion, after which the oil pressure in oil passage 82 decreases. The decrease in the oil pressure in oil passage 82 causes releasing of at least some of the aforesaid braking moment, causing, thereby, to the relative motion to increase again, and so on. Oil accumulator 87 provides oil for the oil passage 88 in order to prevent oil passage 88 from being in a state of vacuum.

Figure 9A:
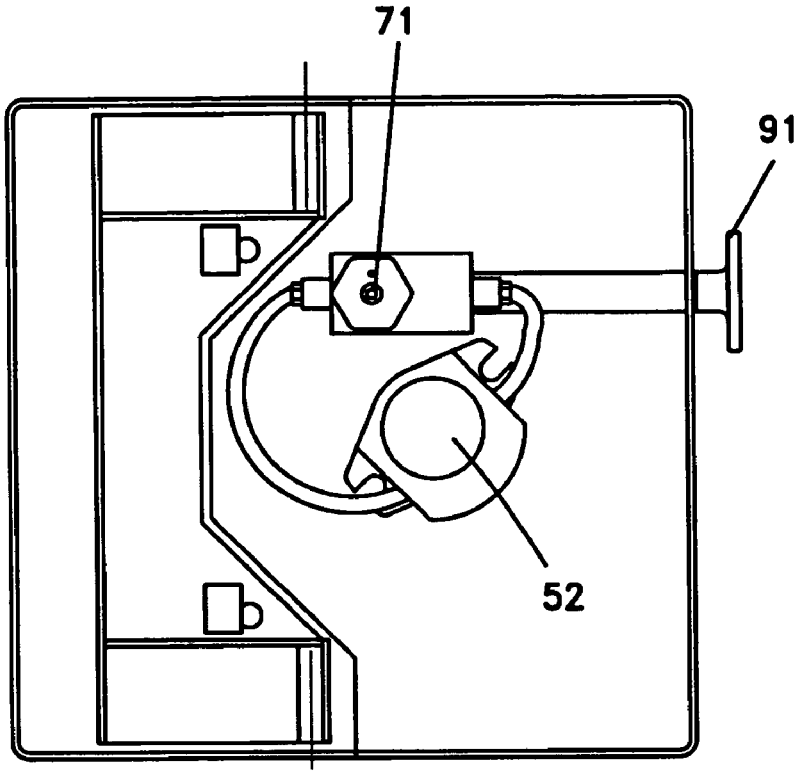
FIGS. 9*a* and 9*b* show a manually-operable mechanical emergency braking arrangement, according to an embodiment of the present invention.
Figure 9B:
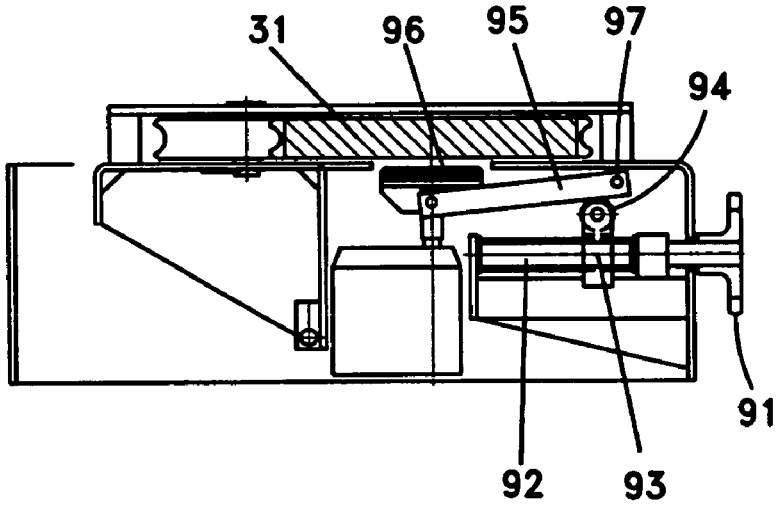

FIGS. 9*a* and 9*b* schematically illustrate a sliding box with manually-operable mechanical emergency brakes, according to an aspect of the present invention. Under normal operating conditions (i.e., a person descends at a regulated velocity), the regulated velocity is automatically maintained by pushing friction strip 96 towards one face of pulley 31, and causing friction strip 96 to retreat from pulley 31, at intervals. Friction strip 96 is pushed and retreated by utilizing a mechanical arrangement such as the one shown in FIG. 8*a* (i.e., rod 83). However, an external intervening means is provided in the sliding box, which allows to manually bypass the automatic mode of operation of the sliding box in emergency cases, or whenever a descending person wishes to slow down his descend. The intervening means operates in the following way: screw-like rod 92 is screwable through nut 93, to which bearing 94 is mechanically affixed. Screw-like rod 92 is rotatable by a person wearing the harness and sliding box 12 for descending, by operating handle 91. When screw-like rod 92 is rotated in one direction, screw 93 and bearing 94, which is affixed thereto, advance along the screw-like rod 92, in a way that bearing 94 slides on lever 95. Since the right end of lever 95 (i.e., according to this example) is rotatable around fixed pivot 97, the movement of bearing 94 to the left-hand side direction (as seen in the drawing) causes friction strip 96, which is affixed to the distal end of lever 95, to be pushed against one face of pulley 31, and, thereby, providing braking moment for slowing down pulley 31, and maintaining a preferred descending velocity of; e.g., 1 meter per second.

Figure 10B:
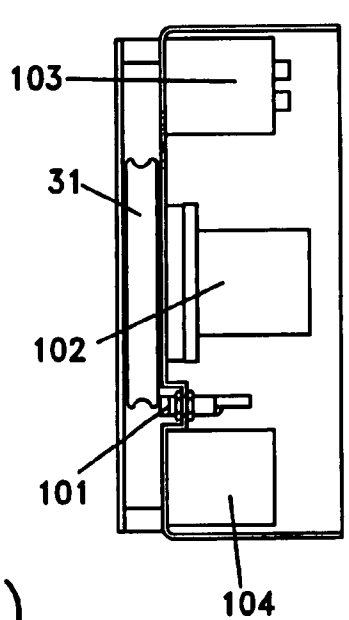
FIGS. 10*a* to 10*c* show a sliding box, according to another preferred embodiment of the present invention.
Figure 10A:
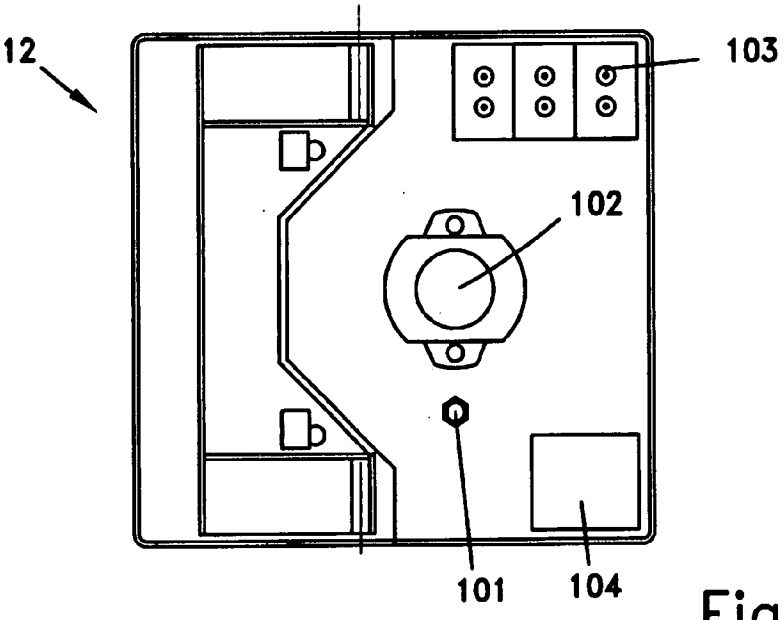
Figure 10C:
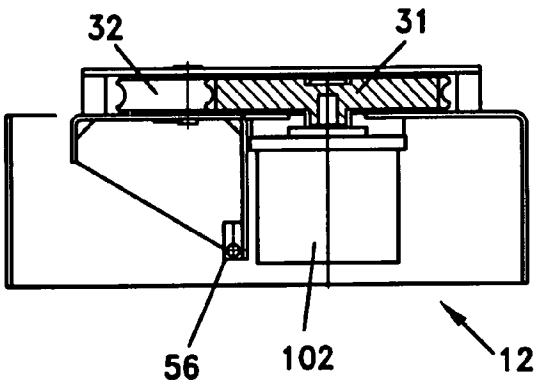

FIGS. 10*a* to 10*c* show a sliding box, according to another preferred embodiment of the present invention. Sliding box 12 includes velocity sensor 101, the function of which is to measure the rotational speed of pulley 31, by generating an electrical signal that represents the rotational speed. Velocity sensor 101 could be, for example, a magnetic pickup sensor, such as any of the magnetic pickup sensors from the NJ series manufactured by Pepperl & Fuchs (P&F), which generates a train of pulses having a frequency that linearly depends on the rotational speed of pulley 31. The train of pulses can be forwarded to control unit 104, which includes electronic circuitry for translating the train of pulses back into rotational speed. Another function of the electronic circuitry contained within electrical control unit 104 is to output electrical control signal to electric motor 102 for generating a magnetic moment that counteracts the mechanical moment exerted on pulley 31 by the descending sliding box 12. The rotational speed, as measured by speed sensor 101, is compared to a ("set-point") rotational speed that corresponds to a wanted (i.e., preferred) descending rate of sliding box 12. The higher the measured rotational speed, with respect to the preferred (i.e., set-point) rotational speed, the stronger is the generated moment, and therefore, the braking force. This way, it is possible to obtain essentially an accurate and uniform sliding rate irrespective of the weight of the descending person.

According to an aspect of the present invention, the control unit includes setting means for allowing a descending person to change the preferred descending rate, by changing the set-point rotational speed of pulley 31. According to an aspect of the present invention, the setting means includes a scale that is calibrated to descending rate (e.g., 0.5, 1.0 and 3.0 meters/second).

Battery pack 103 provides the electric power required by the electronic circuitry inside control unit 104 and by electric motor 102. Utilizing an electric motor for controlling the descend rate allows obtaining a more accurate and stable/fixed descending speed, comparing to the above-mentioned hydraulic solutions.

Figure 11B:
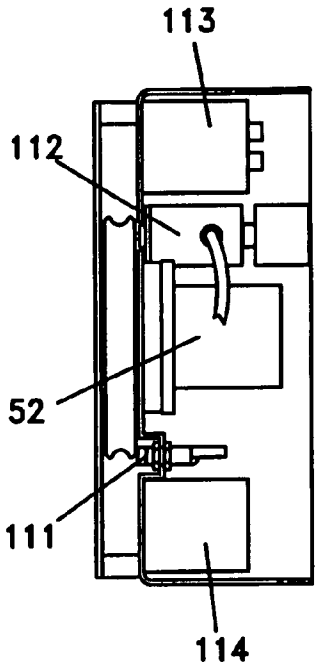
FIGS. 11*a* to 11*c* show an electromechanical sliding box, according to another preferred embodiment of the present invention.
Figure 11A:
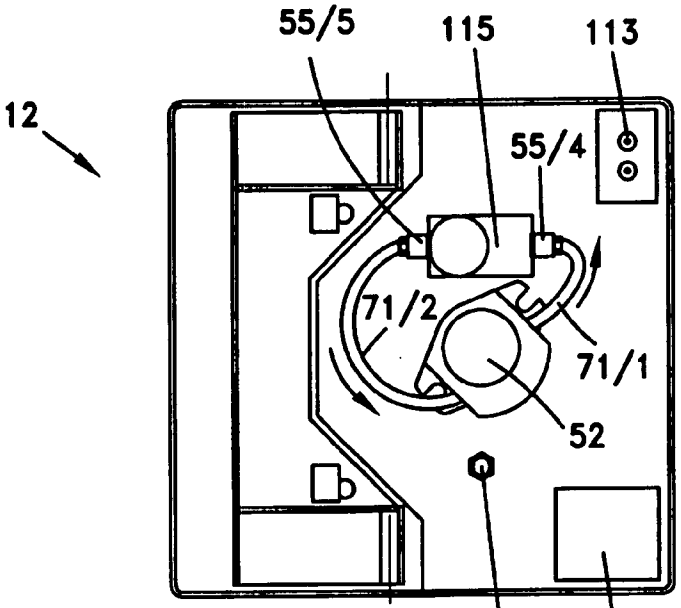
Figure 11C:
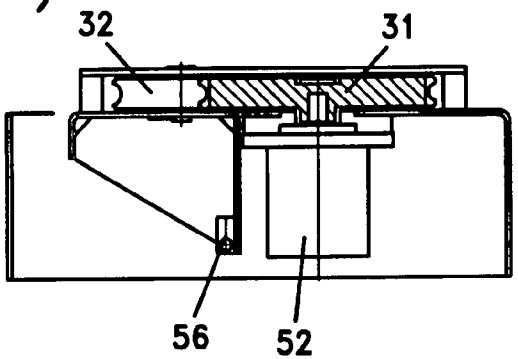

FIGS. 11*a* to 11*c* show an electromechanical sliding box, according to another preferred embodiment of the present invention. According to this embodiment, the mechanical portion of sliding box 12 resembles to the mechanical portion of sliding box 12 shown in FIGS. 7*a* and 7*b*, and FIGS. 8*a* and 8*b*, as it includes oil pump 52, hydraulic control unit 115 and related oil pipes (i.e., 71/1 and 71/2). In addition, according to this embodiment, the electrical portion of sliding box 12 resembles to the electrical portion of sliding box 12 shown in FIG. 10, as it also includes speed sensor 101 and electronic control unit 104. However, unlike in the embodiment shown in FIG. 10, according to this embodiment the electronic control unit (i.e., electronic control unit 101) receives the picked-up train of pulses, which corresponds to the descend speed, and outputs a corresponding controlling electric signal that is forwarded to the hydraulic portion for regulating the descend speed.

Figure 12B:
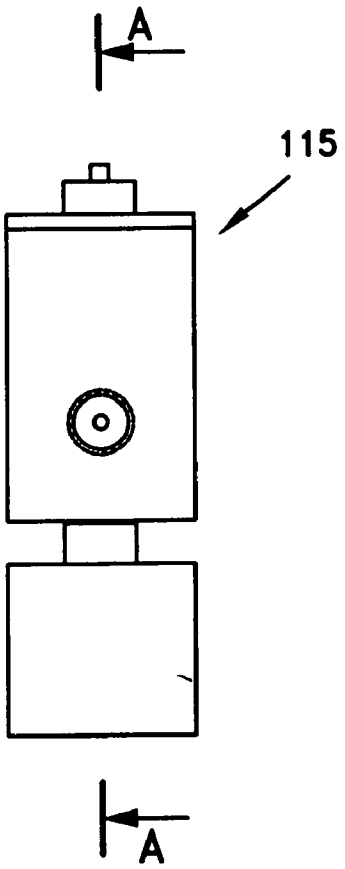
FIGS. 12*a* and 12*b* show in more details the internal structure of the electromechanical speed control unit shown in FIG. 11.
Figure 12A:
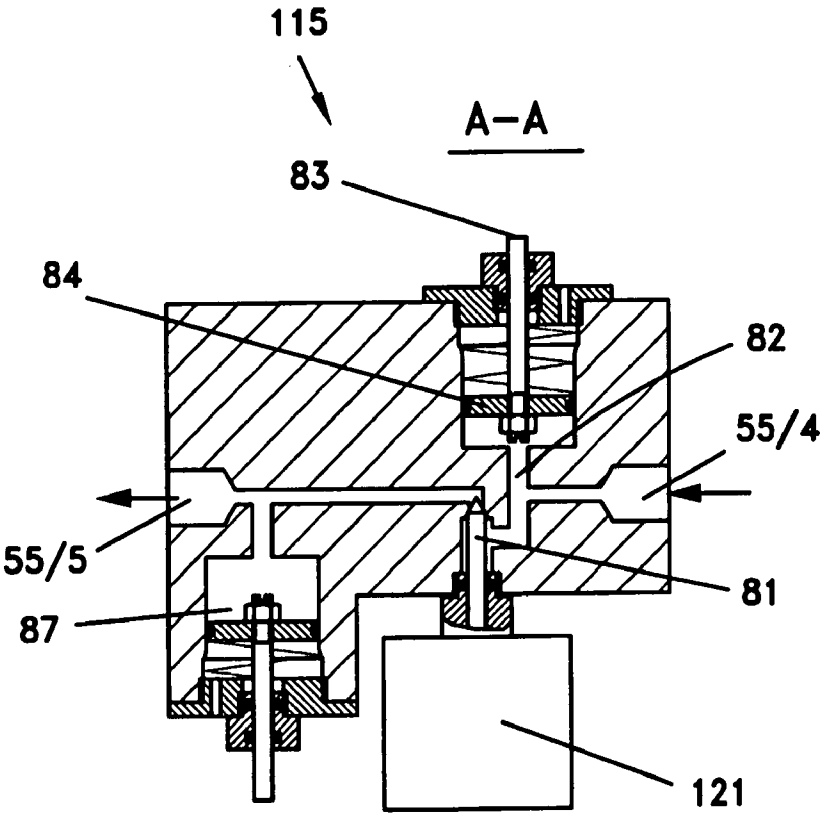

FIGS. 12*a* and 12*b* show in more details the internal structure of the electromechanical speed control unit shown in FIG. 11. The functionality of speed control unit 115 is essentially the same as the functionality of speed control unit 71 (see, for example, FIG. 8*a*), except that in speed control unit 115, the needle valve 81 is operated electrically (i.e., by electromechanical means 121) rather than by hydraulic piston that is movable in accordance with an oil pressure.

The controlling electric signal, which is outputted by electronic control unit 114 (FIG. 11), moves the hydraulic needle valve 81 so as to open/close the oil passage between inlet 55/4 and outlet 55/5. When the descending speed is zero, oil pump 52 (FIG. 11) does not circulate oil in the hydraulic system, needle valve 81 is in "retracted" position and a free passage of oil is allowed between oil inlet 55/4 and outlet 55/5. As the descend speed starts to increase, oil pump 52 starts circulating oil; i.e., oil is pushed by the oil pump through inlet 55/4 and oil returns to the oil pump through outlet 55/5. However, along side with the increase of the descend speed, electronic control unit 114 (FIG. 11) outputs an electric signal to electromechanical means 121, which moves needle valve 81 so as to partially close the oil passage between inlet 55/4 and outlet 55/5. As a result of the partial closure of the aforesaid oil passage, the oil pressure in oil passage 82 increases, and piston 84 moves upwards, so as to cause friction end 83 to be pushed against pulley 31, for employing a counteracting force there against, in order to prevent pulley 31 from further increasing its rotational speed. The more the descend speed tends to increase (i.e., due to gravitational force and a descending person having heavier weight), the more the needle valve (81) will close the oil passage between inlet 55/4 and outlet 55/5, and the higher pressure will be built in oil passage 82, which will result in a stronger counteracting (i.e., braking) force that is employed on pulley 31.

FIG. 13 shows the proportion between an exemplary sliding box and cable and a person's hand, according to the present invention. Hand 131 is shown gripping escape cable 21 (i.e., only for illustrating purpose), which is shown after having been inserted into sliding box 12. Sliding box 12 includes projecting "eyes" 133 (only three are shown), which are intended to be connected to a harness that the person has to wear (see harness 11 in, e.g., FIG. 11). In order to insert escape cable 21 into sliding box 12, the person opened sliding box 12 around pivot axis 56 (see also, for example, FIG. 5*a*). Reference numerals 134 and 135 denote securing elements, the function of which is securing sliding box 12 in its close position, for preventing unintentional escaping of escape cable 21 from sliding box 12. When a person utilizes sliding box 12 to descend, securing elements 134 and 135 face the wall of the building (i.e., away from the descending person), in order to ensure that the descending person does not accidentally (e.g., out of panic) opens sliding box 12. Wheels 136 prevent friction between the external side of the wall of the building and the sliding box. Wheels 136 can be of any suitable size. Wheels 136 can be replaced by any other friction-preventing, or friction-protecting, means. For example, a friction-protecting means can be an arcuated plate, which could be made of metal, plastics, etc.

The sliding box shown in FIG. 13 is only a prototype, and the commercial sliding box is intended to be as small as half the size of the prototype sliding box.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. An escape device comprising a sliding box adapted to be worn by each escaping person, said escape device being combined with an escape cable, said sliding box comprising:

a supporting structure;

a driven wheel supported in said structure for rotation, said wheel being adapted to be in engagement with said escape cable and to be driven thereby into rotation with a rotary speed corresponding to the speed of the motion of said sliding box relative to said escape cable, and therefore adapted to be corresponding to the speed of descent of said escaping person;

means for measuring said rotary speed of said driven wheel and therefore also for measuring said speed of descent of said escaping person; and brake means for slowing the rotation of said driven wheel, and therefore also for slowing the speed of descent of the escaping person, whenever required to maintain said speed of descent within predetermined limits;

wherein the sliding box is provided with a control which is adapted to receives the measurement of the speed of descent of the escaping person, compares it with a predetermined desired speed, and if it is greater than said desired speed, actuates the aforesaid brake means to reduce it to said desired speed; and wherein the control is implemented by a hydraulic system and comprises:

an oil pump, the rotation axis of which is mechanically coupled to the rotation axis of the driven wheel, for transferring rotational motion from said driven wheel to said oil pump, and for providing a counteracting force, being generated by said oil pump in response to said rotational motion, to said driven wheel, for regulating said rotational motion;

a hydraulic control unit, comprising:

an oil inlet, connected to the oil outlet of said oil pump and to an oil passage inside said control unit;

a regulating valve, for closing/opening said oil inlet of said control unit, for regulating the flow rate of the oil passing through said oil inlet, and thereby, the pressure in said oil passage, said regulating valve comprising a piston connected to a rod movable through a sealed opening, said piston being movable inside a cylindrical housing and its position inside said cylindrical housing being determined according to the pressure exerted by a spring on one of its sides, and a pressure exerted on its other side by oil, being contained within said cylindrical housing, having a free access to said oil passage;

a valve, for determining the rate of oil entering said cylindrical housing;

an accumulator, comprising a piston connected to a rod movable through a sealed opening, said piston being movable inside a cylindrical oil reservoir, connected to said oil passage, and its position in said cylindrical oil passage being determined according to the pressure exerted by a spring on one of its sides, and a pressure exerted on its other side by the oil contained within said oil reservoir, the rod of said accumulator and the rod of said regulating valve being mechanically coupled to one another in a way that whenever the rod of the regulating valve moves to close the oil inlet of the control unit, the rod, and therefore the piston, of said accumulator being moved in a way that oil from said cylindrical oil reservoir is pushed, via said oil passage, to fill the additional volume that is created by the movement of the rod of the regulating valve, said oil reservoir allowing changes in said oil passage while a relative motion is being regulated;

an oil outlet, said oil outlet being connected to said oil inlet of said oil pump; and an adjustable valve, for allowing changing the flow rate threshold of oil returning to said oil pump through said oil outlet of said hydraulic control unit.

2. An escape device according to claim 1, further comprising a braking cylinder, for employing a mechanical brake force directly on the driven wheel, which braking cylinder comprising a piston, connected to a rod movable through a sealed opening, the position of said piston being determined according to a first force exerted on one side of the piston by a spring, and a second force that counteracts the first force and is exerted on the other side of the piston by the oil pressure existing in the oil passage, one end of said movable rod being connected to said piston, and the other end of said rod being connected to a rubbing strip, said piston being pushed outwards, with respect to the hydraulic control unit, whenever the pressure in said oil passage increases as a result of an increase in the relative motion, thereby pushing said rubbing strip against said driven wheel, for providing a counteracting or braking force that will limit the increase in the relative motion, said pressure increase in the oil passage pushing outwards also the piston of an hydraulic needle valve for causing the oil passage between the oil inlet and oil outlet to open, for allowing reducing the relatively high pressure in the oil passage, after which said braking force, which is employed on the driven wheel by said rubbing strip, is reduced, or weakened, said hydraulic needle valve regulating the flow rate of the oil passing between the oil inlet and the oil outlet, through said oil passage.

3. An escape device according to claim 2, further comprising an electro-mechanical system for exerting brake force on the rubbing strip, comprising:

a speed sensor, for monitoring the rotational speed of the driven wheel, and thereby, the descend speed, said speed sensor generating an electrical signal that represents the rotational speed of said driven wheel;

an electro-mechanical needle valve, for closing/opening the oil passage inside the hydraulic control unit, for regulating the flow rate of the oil passing between the oil inlet and the oil outlet of the hydraulic control unit, and thereby, the pressure in the oil passage, said electro-mechanical needle valve translating electrical signals to physical positioning of a needle-like rod that is movable through a sealed opening;

an electronic control unit, for accepting the electrical signal and generating a corresponding output signal to the electro-mechanical needle valve, for determining the position of said needle-like rod, thereby regulating the braking force employed on said driven wheel; and a battery pack, for powering said speed sensor, said electronic control unit and said Electro-mechanical needle valve.

4. An escape device comprising a sliding box adapted to be worn by each escaping person, said escape device being combined with an escape cable, said sliding box comprising:

a supporting structure;

a driven wheel supported in said structure for rotation, said wheel being adapted to be in engagement with said escape cable and to be driven thereby into rotation with a rotary speed corresponding to the speed of the motion of said sliding box relative to said escape cable, and therefore adapted to be corresponding to the speed of descent of said escaping person;

means for measuring said rotary speed of said driven wheel and therefore also for measuring said speed of descent of said escaping person;

brake means for slowing the rotation of said driven wheel, and therefore also for slowing the speed of descent of the escaping person, whenever required to maintain said speed of descent within predetermined limits; and emergency brake means adapted to be actuated by the escaping person, if required;

wherein the emergency brake means comprises a screw-like rod, handle, nut, bearing, lever, pivot and mechanical arrangement that functions to keep the screw-like rod in a fixed longitudinal position with respect to the sliding box, said screw-like rod being screwable through said nut, to said nut said bearing is mechanically affixed, said screw-like rod being intended to be rotated by a person utilizing the sliding box for descending, by operating a handle that is coupled to said screw-like rod, causing said nut, and bearing, to slide along said lever so that a rubbing strip, which is affixed to the distal end of said lever, pushes one side of the driven wheel, and, thereby, provides a braking force for slowing said driven wheel to an arbitrary rotary speed, or slowing said driven wheel to a predetermined minimal rotary speed, or, if so required, for slowing said driven wheel until said driven wheel, and therefore, the sliding box, is completely stopped.

5. An escape device comprising a sliding box adapted to be worn by each escaping person, said escape device being combined with an escape cable, said sliding box comprising:

a supporting structure;

a driven wheel supported in said structure for rotation, said wheel being adapted to be in engagement with said escape cable and to be driven thereby into rotation with a rotary speed corresponding to the speed of the motion of said sliding box relative to said escape cable, and therefore adapted to be corresponding to the speed of descent of said escaping person;

means for measuring said rotary speed of said driven wheel and therefore also for measuring said speed of descent of said escaping person;

brake means for slowing the rotation of said driven wheel, and therefore also for slowing the speed of descent of the escaping person, whenever required to maintain said speed of descent within predetermined limits; and emergency brake means, to be actuated by the escaping person, if required;

wherein the sliding box is provided with a control which is adapted to receives the measurement of the speed of descent of the escaping person, compares it with a predetermined desired speed, and if it is greater than said desired speed, actuates the aforesaid brake means to reduce it to said desired speed; and wherein the emergency brake means comprises a screw-like rod, handle, nut, bearing, lever, pivot and mechanical arrangement that functions to keep the screw-like rod in a fixed longitudinal position with respect to the sliding box, said screw-like rod being screwable through said nut, to said nut said bearing is mechanically affixed, said screw-like rod being intended to be rotated by a person utilizing the sliding box for descending, by operating a handle that is coupled to said screw-like rod, causing said nut, and bearing, to slide along said lever so that a rubbing strip, which is affixed to the distal end of said lever, pushes one side of the driven wheel, and, thereby, provides a braking force for slowing said driven wheel to an arbitrary rotary speed, or slowing said driven wheel to a predetermined minimal rotary speed, or, if so required, for slowing said driven wheel until said driven wheel, and therefore, the sliding box, is completely stopped.

* * * * *